United States Patent [19]

Thomas

[11] Patent Number: 5,010,980

[45] Date of Patent: Apr. 30, 1991

[54] ASSEMBLY FOR LOWERING A PERSON TO SAFETY FROM A BUILDING

[76] Inventor: Richard B. Thomas, 10 Quintard Ave., Old Greenwich, Conn. 06870

[21] Appl. No.: 557,064

[22] Filed: Jul. 25, 1990

[51] Int. Cl.[5] ..... A62B 1/00

[52] U.S. Cl. ..... 182/236; 182/71; 182/231

[58] Field of Search ..... 182/231, 232, 234, 235, 182/70, 73, 236, 237, 239, 240, 71, 72

[56] References Cited

U.S. PATENT DOCUMENTS 654,415 7/1900 Rinn ..... 182/72

FOREIGN PATENT DOCUMENTS 1361187 12/1964 France ..... 182/72

*Primary Examiner*—Alvin C. Chin-Shue

*Attorney, Agent, or Firm*—Terry M. Gernstein

[57] ABSTRACT

An assembly for lowering a person to safety from a building under a descent operation that is controlled by the person without requiring such person to manipulate a hand operated device, such as a lever. The assembly includes a rope which is connected to a storage drum via guide rollers and which passes through a gap defined by a cam element. The cam element is biased to rotate, and when in a first position jams the rope element against further movement off of the storage drum. The cam element automatically moves into the first position and is moved out of that position when the person jumps upwardly.

5 Claims, 5 Drawing Sheets

ASSEMBLY FOR LOWERING A PERSON TO SAFETY FROM A BUILDING

TECHNICAL FIELD OF THE INVENTION

The present invention relates to the general art of winding and reeling, and to the particular field of assemblies used to lower a person from a building.

BACKGROUND OF THE INVENTION

Fires are a major cause of death and injury in this country, and throughout the world. Fires can occur in single story buildings and can cause great destruction through the fire as well as via the smoke associated with such occurrence.

However, even more devastating than the damage and injury caused by fires in single story dwellings is the damage, injury and destruction associated with fires occurring in multiple story and high rise buildings. In such buildings, people are often trapped in upper stories, with the fire department unable to efficiently rescue them. Many times, these people are injured when they try to jump to safety. Since it is not advisable to use an elevator to in a fire emergency, many people, especially those who are handicapped and cannot walk, become trapped in the upper stories of high rise buildings.

The problem of rescue is compounded if the person being rescued is incapacitated or handicapped. This is often the case in a retirement home situation where the occupants are often handicapped and must be almost physically carried out of the building.

The problem of escaping a fire in a high rise building has engendered many different devices that are intended to lower a person to safety from a building. Examples of such devices are shown in patents such as U.S. Pat. Nos. 612,673, 1,241,701, 4,580,658 and 4,714,137 which disclose devices that are attached to the sill of a building window include a harness that encircles the user. The user controls the descent by manipulating a lever.

While somewhat effective, these devices have a shortcoming that prevents their use in many situations. The requirement that the user manipulate some form of hand control, such as a lever, or the like, to control the descent prevents these devices from being used in situations such as mentioned above wherein the user may be handicapped and not have full manipulative ability in their hands. This is especially true in the above-mentioned retirement home situation, but can also occur if the user is otherwise incapacitated, such as being unconscious or, is a young child, or the like.

Under such circumstances, the devices that require manipulation of a hand control to control descent will not be useful.

Accordingly, there is a need for an assembly for lowering a person to safety from a building which can be operated without the use of the user's hands and thus can be operated by someone having some impairment of the manipulative ability of their hands or fingers, and which can be operated without requiring the user to manipulate their fingers at all.

OBJECTS OF THE INVENTION

It is a main object of the present invention is to provide an assembly for lowering a person to safety from a building which can be operated without the use of the user's hands.

It is another object of the present invention to provide an assembly for lowering a person to safety from a building which can be operated without the use of the user's hands and can be operated by someone having some impairment of the manipulative ability of their hands or fingers.

It is another object of the present invention to provide an assembly for lowering a person to safety from a building which can be operated without the use of the user's hands and can be operated by someone having some impairment of the manipulative ability of their hands or fingers, and which can be operated without requiring the user to manipulate their fingers at all.

SUMMARY OF THE INVENTION

These, and other, objects are achieved by an assembly for lowering a person to safety from a building which is operated by encircling a loop about the person, and which permits that person to control the descent by jumping or swinging movements of their body.

The person simply jumps up and down to cause the assembly to lower him to safety. In this manner, even if the person has severely impaired hand manipulative ability, as may be associated with arthritis or the like or is otherwise incapable of using their hands in a manipulative sequence, that person can still be lowered to safety from a building.

BRIEF DESCRIPTION OF THE DRAWING FIGURES

DETAILED DESCRIPTION OF THE PREFERRED EMBODIMENT OF THE INVENTION

Figure 1:
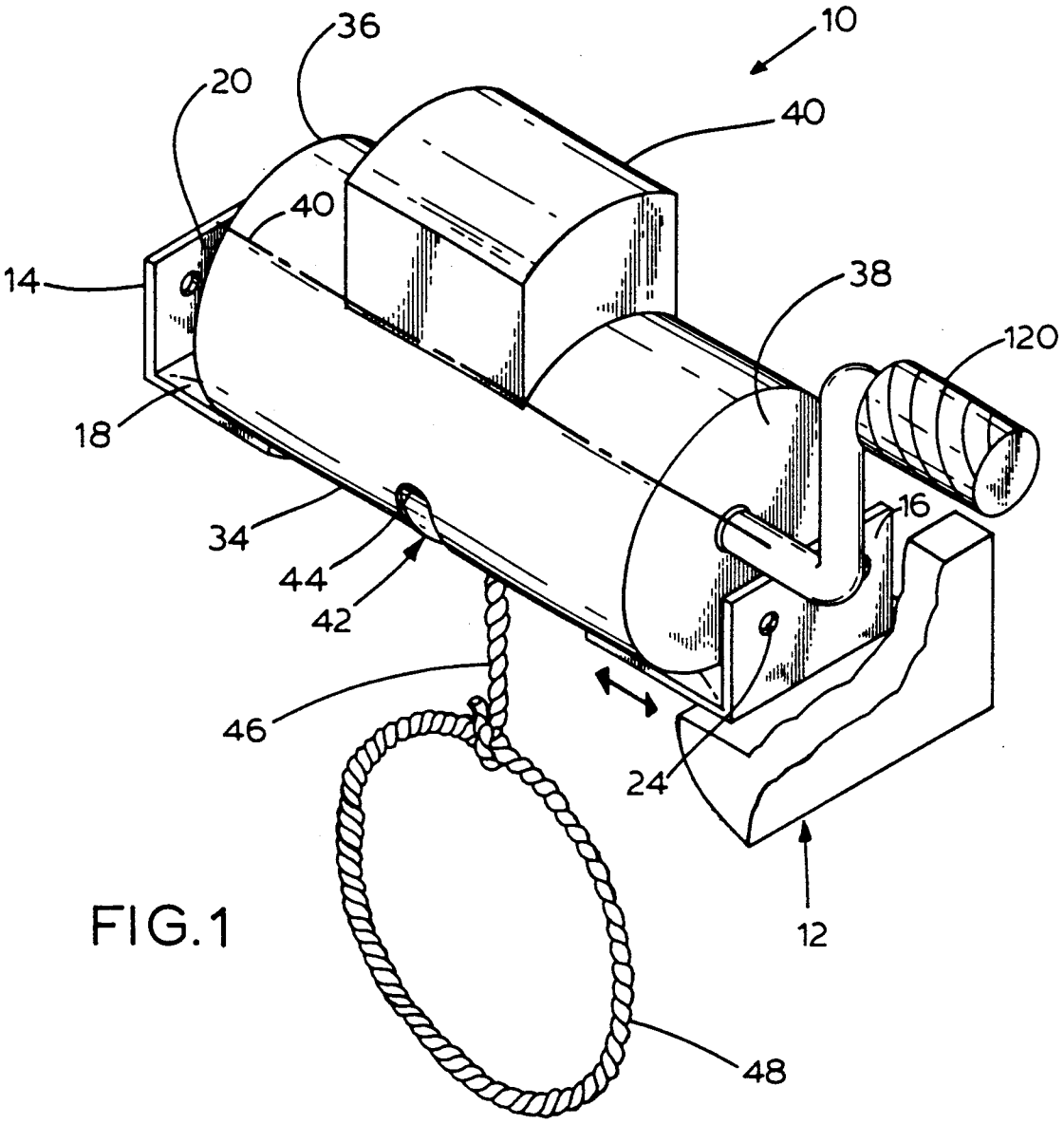
FIG. 1 is a perspective view of the assembly embodying the present invention.

Shown in FIG. 1 is an assembly 10 for lowering a person to safety from a building and which can be manipulated to control descent without the use of the user's hands.

The assembly 10 is adapted to be releasably mounted in a sill 12 of a building window, and which can be removed during periods of non-use. The device is removed from storage and mounted for use, and thus is adapted for quick mounting, as such mounting will likely be conducted under emergency conditions.

The window sill is shown in only a sketchy manner, as those skilled in the art will understand what elements are included in a building window sill.

Figure 2:
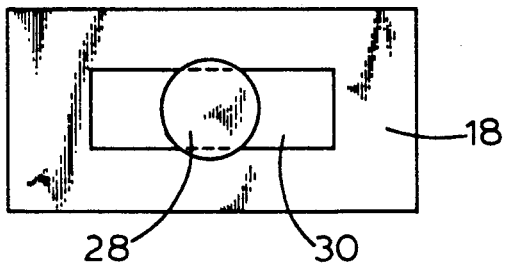
FIG. 2 is bottom view of a bracket used to attach the assembly to a sill of a building window.

The assembly 10 includes two identical brackets 14 and 16, each of which is L-shaped to have a long leg 18 and a short leg 20, with the long leg having an elongated slot 22, best shown in FIG. 2, defined therethrough. The short leg includes two fastener-receiving holes 24 defined therethrough, and fasteners, such as self-tapping screws or the like, are inserted through the holes 24 to attach the brackets to the side of the window sill. A fastener 28, such as a bolt, a self-tapping screw, or the like, is accommodated through an elongated hole 30 defined through the long leg 18 of the bracket. Moving the bracket with respect to the fastener 28 permits the size of the assembly to be adjusted to fit a particular window sill. The fastener 28 and the slot 30 can be arranged so that the fastener is fixed to the sill and the bracket slipped onto such fastener. Such mountings are known to those skilled in the art, and thus will not be further discussed.

The assembly further includes a hollow cylindrical housing 34 which includes ends 36 and 38, and has a longitudinal centerline 40. The housing is attached to the brackets adjacent to the ends 36 and 38, and includes a hollow vault section 40 thereon. An elongated slot 42 is defined through the housing to extend radially around the housing from one end 44 thereof and is oriented downwardly toward the ground when the assembly is properly mounted on the window sill.

The assembly further includes a rope element 46 depending from the housing. The rope element 46 includes a user-encircling loop 48 on one end thereof, and is adapted to be lowered and raised by operation of the assembly. The loop engages the drum during storage.

The assembly 10 further includes a rope element storage and deployment unit 50, a first form of which is best shown in FIGS. 3–6. This unit permits the rope element 46 to be lowered without manipulation of hand operated elements, such as levers, etc.

Figure 3:
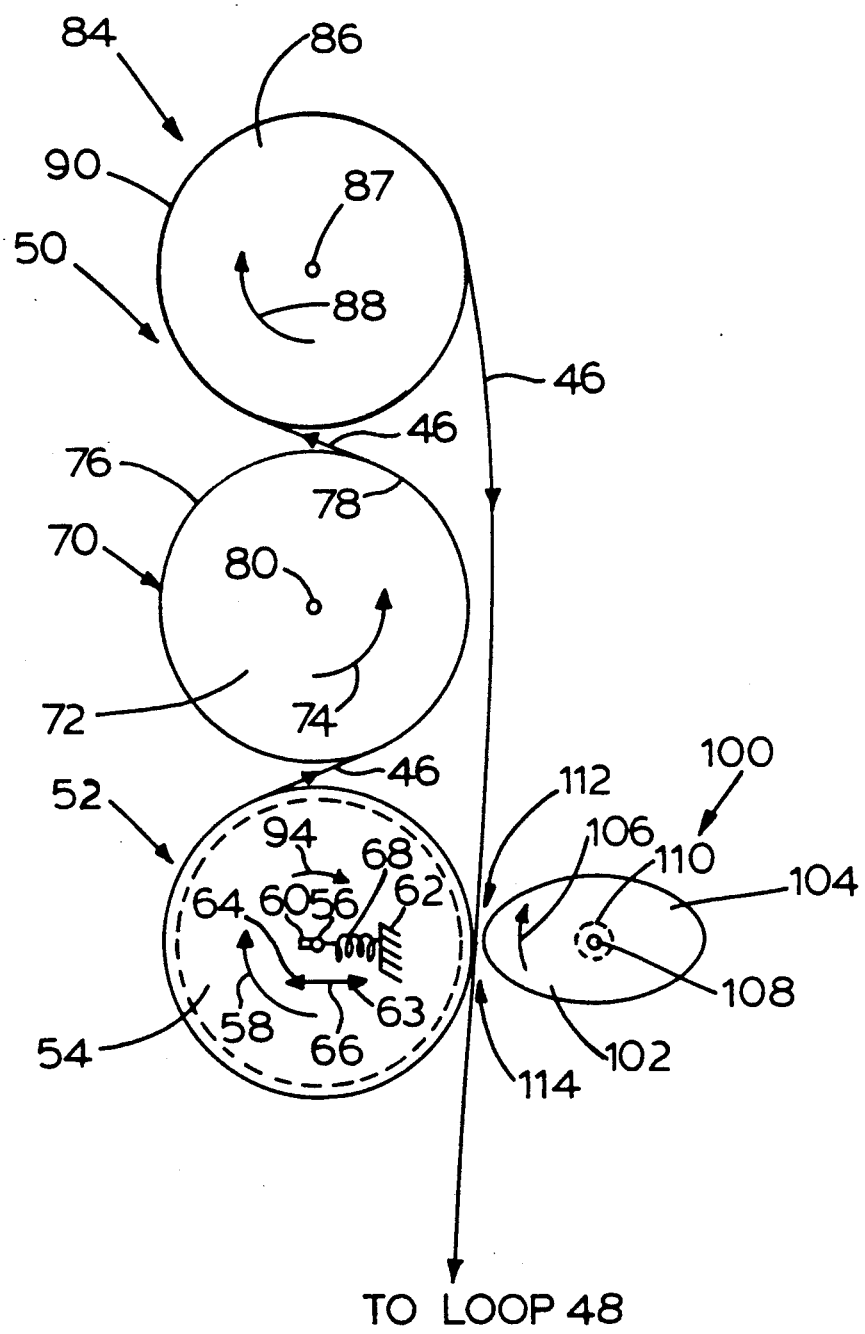
FIG. 3 is an elevational view of a rope element storage and deployment unit of the assembly in a position just as the rope is jammed to stop the descent of the user.

As best shown in FIG. 3, the unit 50 includes a rope storage drum 52 that is cylindrical in shape and includes two ends, such as end 54, with the rope element 46 being wound about the storage drum for storage and for deployment therefrom. The storage drum 52 has a longitudinal centerline and is mounted for rotation thereabout on a support axle 56 that is located on that longitudinal centerline. The drum 52 rotates in the clockwise direction indicated in FIG. 3 by arrow 58 to deploy rope for descent purposes.

The support axle 56 is located in an elongated slot 60 for movement toward and away from a mounting element 62 that is firmly affixed to the housing 34 so that the storage drum can move in the direction 63 toward the mounting element, and in direction 64 away from the mounting element as indicated by double-headed arrow 66. A spring element 68 connects the axle 56 to the mounting element in a manner that permits the drum to rotate as above discussed. The spring is adjusted to bias the drum in the counterclockwise direction 64 away from the mounting element 62.

A first guide roller 70 is located adjacent to the storage drum 52, and is also cylindrical in shape with two ends, such as end 72 shown in FIG. 3. The first guide roller 70 receives rope 46 from storage drum 52, and rotates in the direction indicated by arrow 74 during the descent phase of the operation of the assembly 10. The first guide roller has an arcuate periphery 76, and the rope engages a first portion 78 thereof as it passes off of the storage drum and around the first guide roller. For the purposes of description, the location at which the rope leaves the storage drum during the descent phase will be referred to as the twelve o'clock position, and the location of the first guide roller immediately adjacent to the storage drum twelve o'clock position will be referred to as the six o'clock position. The first peripheral portion 78 of the first guide roller extends from immediately adjacent to the six o'clock position on that roller counterclockwise through the three o'clock position to adjacent to the twelve o'clock position on that roller. The first guide roller has a longitudinal centerline and has a mounting axle 80 extending along that longitudinal centerline and rotates about such axle 80. The guide roller rotates in the counterclockwise direction during the descent phase of the operation.

The assembly 10 further includes a second guide roller 84 that is mounted on the housing to be adjacent to the first guide roller 70. The guide rollers and the storage drum are mounted on the housing to be in a stacked configuration and the vault section of the housing accommodates the stacked rollers and drum. The second guide roller 84 is located so that the first guide roller 70 is interposed between the second guide roller 84 and the storage drum 52. The rollers and the storage drum are oriented to be essentially parallel to each other.

The second guide roller 84 is also cylindrical in shape and has two identical ends, such as end 86, and a longitudinal centerline that extends from one end to the other. The second guide roller 84 includes a mounting axle 87 about which the second guide roller rotates in the clockwise direction indicated by arrow 88 during deployment of the rope during the descent phase of the operation.

The second guide roller 84 also includes an arcuate surface 90, and is located to have the six o'clock position thereof positioned immediately adjacent to the twelve o'clock position of the first guide roller. The rope 46 contacts the second guide roller from adjacent to the six o'clock position on that second guide roller to near the three o'clock position and extends clockwise around that second guide roller.

As can be seen from FIG. 3, as the rope 46 is deployed off of the storage drum, a force is exerted on that drum due to the snaking of the rope about the guide rollers 70 and 84. This force is indicated in FIG. 3 by arrow 94. This force acts against the force of the spring 68 to force the storage drum in the direction 63 towards the mounting element 62.

The rope leaves the second guide roller 84 near the three o'clock position of that roller, and drops downwardly past the first guide roller and past the storage drum, passing the storage drum near the three o'clock position of that drum. The loop 48 is connected to that rope at a remote end thereof.

As is also shown in FIG. 3, the unit 50 also includes an elliptical cam 100 that is rotatably mounted on the housing 34 adjacent to the three o'clock position of storage drum 52. The cam 100 includes two lobes 102 and 104 and rotates in the clockwise direction as indicated by arrow 106 about an axle 108 that is mounted on the housing 34 during the deployment of the rope 46. The cam 100 also includes a torsion spring 110 attached at one end thereof to the axle 108 and at the other end thereof to the housing 34. The spring 110 biases the cam to rotate in the clockwise direction 106.

The cam 100 is mounted and sized to snugly engage the storage drum, either against the rope stored thereon or against a special flange thereon, when either of the cam lobes 102 or 104 is in the nine o'clock position shown in FIG. 3. The snug engagement of the cam and the storage drum forms a nip 112 into which the rope 46 feeds and an exit 114 out of which the rope passes during a descent operation. The snug and abutting contact between the cam and the storage drum jams the rope in place and prevents further feeding of that rope. Such jamming prevents further descent of the loop 48.

As can be seen by inspecting FIG. 3, the force 94 operates to force the storage drum into a position that will create the aforediscussed jamming contact between that drum and the cam lobes as the rope 46 is moved off of the storage drum during the descent operation. However, as soon as this force is relaxed, the force of spring 68 moves the storage drum in direction 64 away from the jamming position so that the cam lobe can pass by the contact point on the storage drum.

Figure 4:
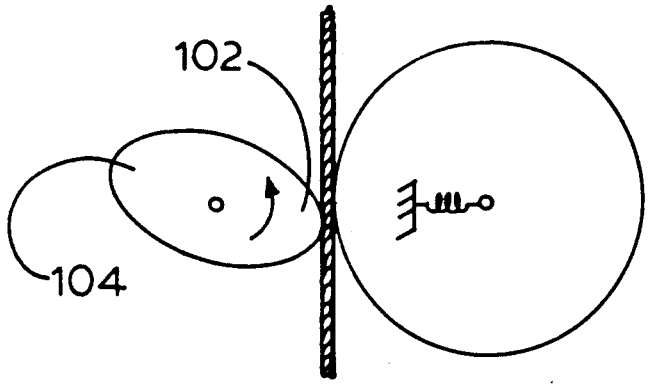
FIG. 4 is an elevational view of a rope element storage and deployment unit of the assembly in a position just prior to and jamming of the rope element for stopping descent.
Figure 5:
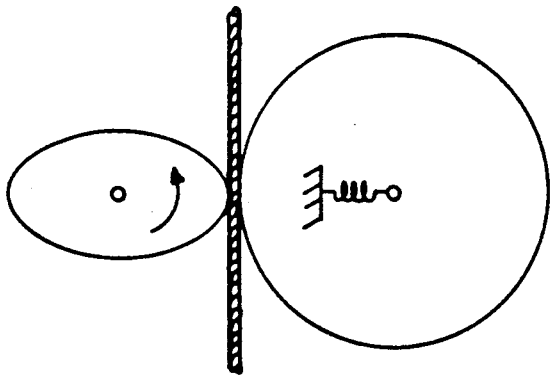
FIG. 5 is an elevational view of a rope element storage and deployment unit of the assembly in a position just at the jamming of the rope element and just prior to release of the rope element for descent.
Figure 6:
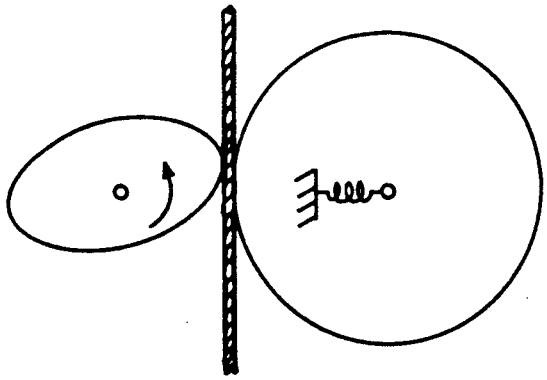
FIG. 6 is an elevational view of the rope element storage and deployment unit of the assembly in a position just after release of the rope element.

This sequence is illustrated in FIGS. 4, 5 and 6 with the cam 100 shown in FIG. 4 just before it jams the rope against the storage cylinder, in FIG. 5 at jamming contact, and in FIG. 6 just after the downward tension on the rope 46 has been relaxed so that the storage drum is moved under the influence of spring 68 away from the cam 100 thereby permitting the spring 110 to move the cam 100 on past the FIG. 3 and FIG. 5 position. Such orientation of the cam 100 relative to the storage drum permits the rope to pass through the nip 112 and out of the exit 114, thereby deploying a portion of such rope. The deployment of the rope is again stopped when the next lobe 104 moves into the position shown for lobe 102 in FIG. 5 to jam the rope against the storage drum.

Thus, the rope is deployed in spurts, and is stopped until the user relives the force 94 on the storage drum. This relieving of force is accomplished by simply jumping upwards. The descent will not be stopped abruptly due to the curved configuration of the cam lobes. During this jump, the user will have a period of free fall in which the force 94 is relived. As soon as the user enters the free fall period, the cam will move from the FIG. 5 position to the FIG. 6 position, and the rope will be freed from jamming contact against the storage drum. The rope will thus move off of the drum, through the nip 112 and out of the exit 114 until the next cam lobe moves into jamming position.

The rope 46 is rewound onto the drum using a hand crank 120, best shown in FIG. 1. The crank 120 extends out of the housing and is connected to the storage drum 52. Rotation of the hand crank will wind the rope back onto the drum since the pressure on the rope that tends to produce force 94 is relieved, and the storage drum 52 will have moved under the influence of spring 68 into a FIG. 4 or FIG. 6 position relative to the cam. The rope will thus be free to move back through the exit 114 and out of the nip 112 back onto the drum 52. In fact, the force exerted on the drum 52 by the rope during this re-winding operation is in the direction opposite to the direction 94 and thus tends to move the drum in the direction 64 thereby assisting this nip opening process. The hand crank can be replaced by an automatic re-winding mechanism if suitable.

The size and location of the cam, the storage drum and the guide rollers is selected to permit the rope element to move freely through the slot 42 during the descent phase and during the re-winding phase of the operation. Suitable rope guides can be included if necessary to guide the rope out of the slot.

Figure 7:
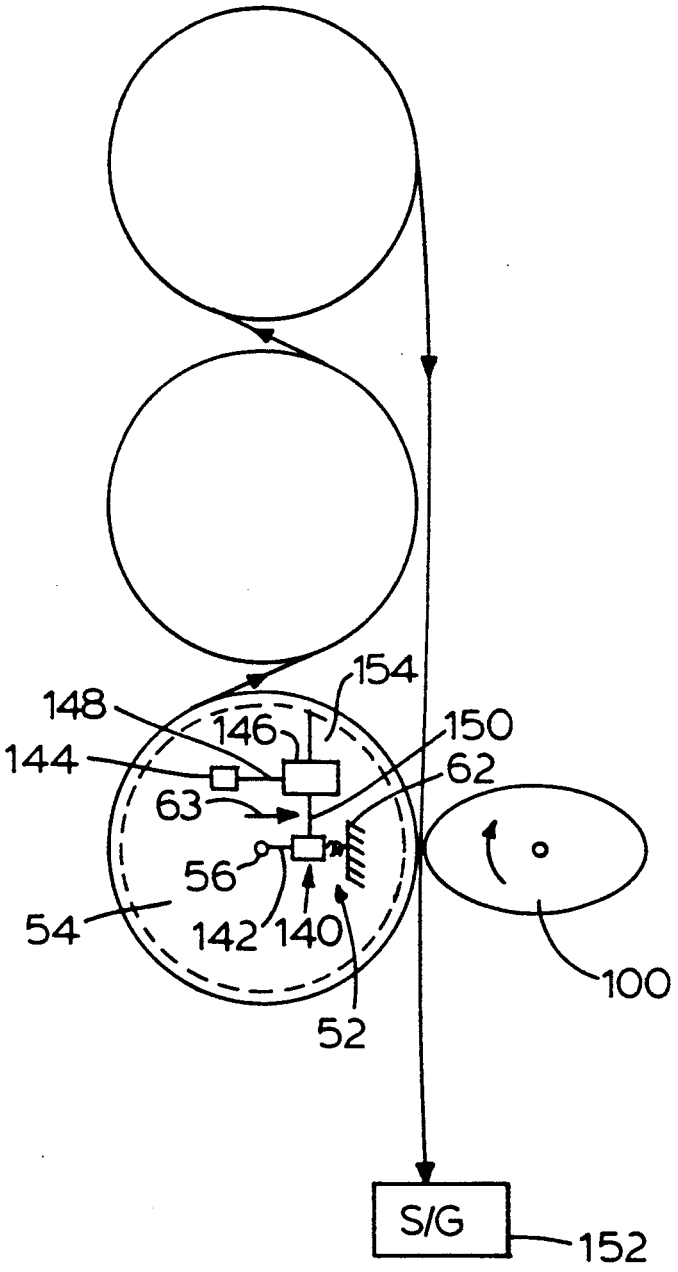
FIG. 7 is an elevational view of a second form of the rope element storage and deployment unit of the assembly in a position during the jamming of the rope element for stopping the descent of the user.
Figure 8:
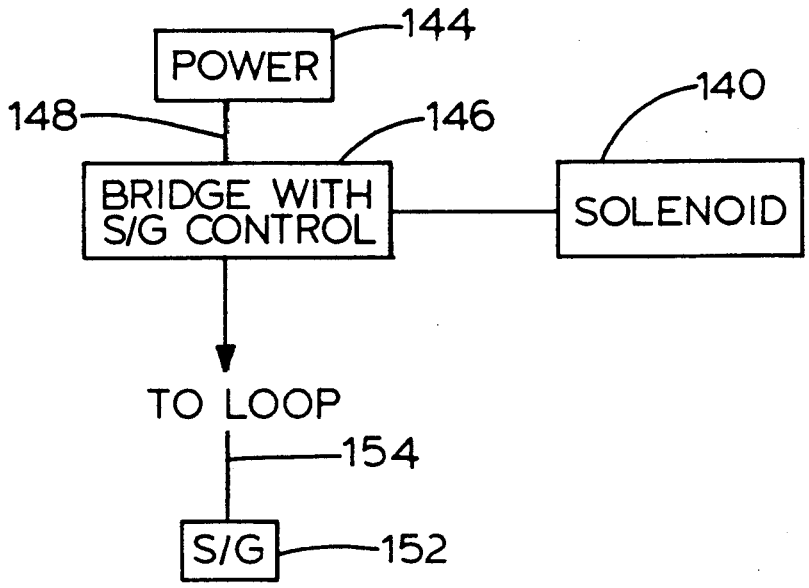
FIG. 8 is a block diagram of a solenoid controlled system for moving the rope storage drum into position to be contacted by the cam to jam the rope against further descent.

Shown in FIGS. 7 and 8 is a second form of the means used to move the rope storage drum 52 into position to be contacted by the cam 100 to jam the rope element against either the drum or against the rope remaining on that storage drum.

The second form of the means includes a solenoid 140 that has a solenoid arm 142 rotatably connected to the storage drum axle 56 and which is connected to the mounting element 62. The solenoid 140 is of the type that moves the arm 142 inwardly of the solenoid when power is applied to that solenoid. Thus, when power is applied to the solenoid, the storage drum 52 will move in the direction 63 towards the mounting element, and hence, towards the cam 100, and into a rope element jamming position.

The solenoid receives power from a power source 144 to be activated. The source 144, can include batteries, or the like, and is connected to the solenoid by a control circuit 146 and line conductors 148 and 150. The control circuit 146 includes a Wheatstone Bridge. The Wheatstone Bridge is constructed to have one arm thereof connected either directly to a strain gauge 152 or to a means for receiving a signal from that strain gauge. The strain gauge 152 is located in the loop 48 of the rope element and emits a signal when the user applies weight thereto. This signal is transmitted to the control circuit Wheatstone Bridge via a line conductor 154 which is embedded in the rope element. The control circuit 146 set up to connect the power source 144 to the solenoid, thus activating that solenoid to pull the storage drum 54 toward the cam 100, whenever the strain on the loop drops below a pre-set level. As soon as the strain on the loop exceeds this pre-set level, the solenoid is de-activated to move the storage drum out of a rope element jamming position relative to the cam 100. The pre-set level of strain is selected to be above any level of strain expected to be experience by the loop 48 during free fall of the user and stopping of that free fall by the cam 100 jamming against the rope. The user places strain on the rope that exceeds this pre-set level by jumping up and down on the rope.

Figure 9:
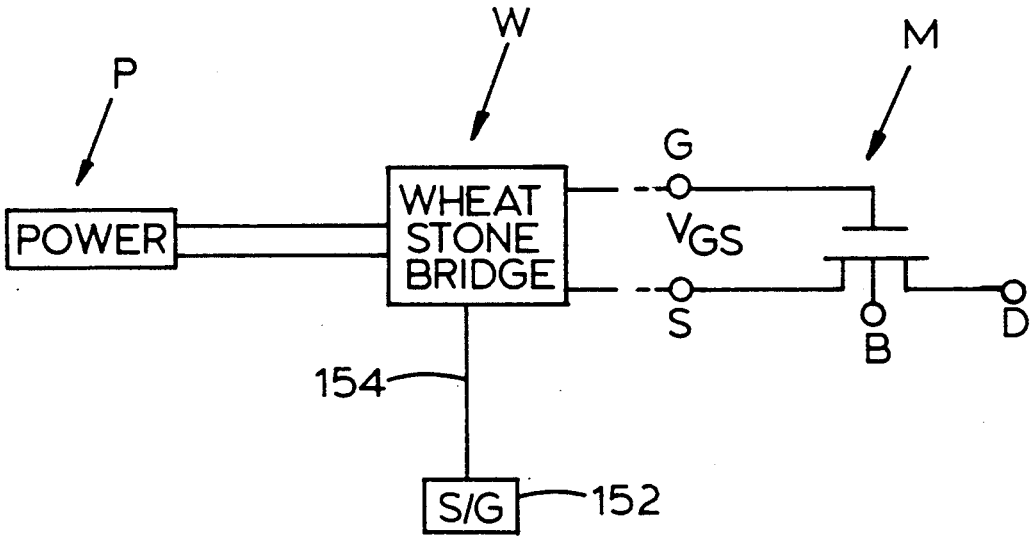
FIG. 9 is a diagram illustrating a circuit for controlling the application of power to the solenoid shown in FIG. 8.

The control circuit includes the aforediscussed Wheatstone Bridge, as well as a circuit element, such as an MOS switch that can be controlled to act in the manner of an on/off switch according to the potential applied thereto. MOS switches are fully disclosed in "Linear Circuits" by M. E. VanValkenburg and B. K. Kinariwala, and which was published by Prentice Hall, Inc in 1982, the disclosure of which is incorporated herein by reference. As discussed in the incorporated text, an MOS switch has a critical voltage, $V_{cr}$ that, when exceeded, turns the switch on in the manner of an on/off switch, and when the $V_{cr}$ is not exceeded, the switch remains off. Potential is applied to the switch across two terminals as $V_{gs}$. An MOS switch M is shown schematically in FIG. 9, and is connected to the Wheatstone Bridge W, and the Bridge Circuit W can include a special power source P whereby the Bridge Circuit controls the $V_{gs}$ associated with the switch to exceed the $V_{cr}$ associated with the switch M, and turn the switch on when the rope element loop is exposed to a strain that is less than the pre-set value. When the strain in the loop 48 is above the preset value, the Wheatstone Bridge W controls $V_{gs}$ to be less than $V_{cr}$ so that the switch is open, thereby de-activating the solenoid. Alternatively, the power source 144 can be used in place of the power source P.

The movement of the drum away from the jamming position permits the cam to move from the FIG. 5 position into the FIG. 6 position thereby freeing the rope for further descent. The user simply waits for the rope to stop descending as the cam 100 jams against the rope, and then jumps up and down with the rope encircled about him. This causes the strain on the rope to exceed the pre-set level, and causes the control circuit 146 to disconnect the power source from the solenoid and de-activating that solenoid so that the drum moves away from the jamming position under the influence of a spring, such as spring 152 connected at one end thereof to the axle 56 and at the other end thereof to the mounting element 62. As soon as the rope continues its descent, the strain associated with the loop will fall below the pre-set level, thereby causing the control circuit 146 to become activated and apply power to the solenoid to pull the drum into the jamming location so that the cam will contact that drum and jam the rope as the next cam lobe reaches the proper location as indicated in FIG. 5.

It is understood that while certain forms of the present invention have been illustrated and described herein, it is not to be limited to the specific forms or arrangements of parts described and shown.

I claim:

1. An assembly for lowering a person to safety from a building comprising:

(A) two bracket elements, each having
  (1) an L-shaped body having a long leg and a short leg,
  (2) fastener elements in said short leg which are attachable to a sill of a building window to releasably mount said each bracket element to that sill, and
  (3) an elongated slot defined through said long leg;

(B) a housing having
  (1) a hollow cylindrical body having two ends and a longitudinal centerline and an elongated slot defined therethrough,
  (2) fastener elements on said hollow body which attach said housing to said bracket elements so that said housing longitudinal centerline is oriented essentially horizontally;

(C) a rope element having a person-supporting loop on one end thereof;

(D) a rope element storage and deployment unit which includes
  (1) a storage drum having a longitudinal centerline and being rotatably mounted inside said housing body, said rope element having a second end affixed to said storage drum and being wound onto said storage drum to be dispensed from said storage drum when said drum rotates about said drum longitudinal centerline in a forward direction during a descent operation, and to be wound onto said storage drum when said storage drum rotates in a reverse direction about said drum longitudinal centerline,
  (2) a support axle mounted on said housing body and attached to said storage drum on said storage drum longitudinal centerline and supporting said storage drum for rotation about said storage drum longitudinal centerline,
  (3) a mounting element firmly affixed to said housing body,
  (4) a spring element attaching said support axle to said mounting element and biasing said support axle in a first direction away from said mounting element,
  (5) a first guide roller located adjacent to said storage drum and including
    (a) a peripheral surface and a longitudinal centerline which is oriented to be parallel to said drum longitudinal centerline,
    (b) a first mounting axle attached to said housing body, said first guide roller being mounted on said first mounting axle to rotate about said first mounting axle, and
    (c) said rope element contacting said first guide roller about a first portion of the peripheral surface of said first guide roller,
  (6) a second guide roller located adjacent to said first guide roller, with said first guide roller being located between said storage drum and said second guide roller, said second guide roller including
    (a) a peripheral surface and a longitudinal centerline which is oriented to be parallel to said first guide roller longitudinal centerline,
    (b) a second mounting axle attached to said housing body, said second guide roller being mounted on said second mounting axle to rotate about said second mounting axle, and
    (c) said rope element contacting said second guide roller about a first portion of the peripheral surface of said second guide roller,
  (7) said first and second guide rollers and said storage drum being in a stacked configuration with said first guide roller first peripheral surface portion being on an opposite side of said first guide roller from said second guide roller first peripheral surface portion so that said rope element snakes around said first guide roller and exerts a rope force on said storage drum which opposes the biasing force exerted on said storage drum by said spring element,
  (8) a cam element mounted on said housing body adjacent to said storage drum, said cam element being mounted on an axle to rotate and having two lobe ends, said lobe ends abutting against the portion of the rope element located on said storage drum when said cam element is in a first position and being spaced from said storage drum to define a gap when said cam element is in a second position as said cam element rotates, said cam element axle being mounted on said housing body,
  (9) a torsion spring connected at one end thereof to said housing body and connected at another end thereof to said cam element axle and biasing said axle to rotate; and (E) said rope element extending between said cam element and said storage drum to be jammed against the portion of said rope element on said storage drum when said cam element is in said first position and preventing further rope from moving off of said storage drum, and to be released when said cam element is in said second position to permit further rope to move off of said storage drum.

2. The assembly defined in claim 1 wherein force associated with jamming contact between said cam element and said rope element is in said first direction.

3. The assembly defined in claim 2 further including a hand crank attached to said storage drum.

4. An assembly for lowering a person to safety from a building comprising:

(A) two bracket elements, each having
  (1) an L-shaped body having a long leg and a short leg,
  (2) fastener elements in said short leg which are attachable to a sill of a building window to releasably mount said each bracket element to that sill, and
  (3) an elongated slot defined through said long leg;

(B) a housing having
  (1) a hollow cylindrical body having two ends and a longitudinal centerline and an elongated slot defined therethrough,
  (2) fastener elements on said hollow body which attach said housing to said bracket elements so that said housing longitudinal centerline is oriented essentially horizontally;

(C) a rope element having a person-supporting loop on one end thereof;

(D) a rope element storage and deployment unit which includes
  (1) a storage drum having a longitudinal centerline and being rotatably mounted inside said housing body, said rope element having a second end affixed to said storage drum and being wound onto said storage drum to be dispensed from said storage drum when said drum rotates about said drum longitudinal centerline in a forward direction during a descent operation, and to be wound onto said storage drum when said storage drum rotates in a reverse direction about said drum longitudinal centerline,
  (2) a support axle mounted on said housing body and attached to said storage drum on said storage drum longitudinal centerline and supporting said storage drum for rotation about said storage drum longitudinal centerline,
  (3) a mounting element firmly affixed to said housing body,
  (4) a solenoid element attaching said storage drum support axle to said mounting element and pulling said storage drum towards said mounting element when activated,
  (5) a control circuit means for activating said solenoid element when a person applies force to said rope element loop, said control circuit means including
    (a) a strain gauge attached to said rope element loop and emitting a signal when force applied to said rope element loop causes said rope element loop to have a strain which exceeds a pre-set level,
    (b) a control means which includes a Wheatstone Bridge which includes said strain gauge as one leg thereof,
    (c) a power source mounted on said storage drum,
    (d) first line conductors connecting said power source to said control means,
    (e) second line conductors connecting said control means to said solenoid,
    (f) said control means being set to connect said power source to said solenoid to activate said solenoid when strain in said rope element loop is below said pre-set level and to disconnect said power source from said solenoid to deactivate said solenoid when strain in said rope element loop exceeds said pre-set level, and
    (g) a drum moving spring attached at one end to said storage drum support axle and at another end to said mounting element and biasing said storage drum away from said mounting element,
  (5) a first guide roller located adjacent to said storage drum and including
    (a) a peripheral surface and a longitudinal centerline which is oriented to be parallel to said drum longitudinal centerline,
    (b) a first mounting axle attached to said housing body, said first guide roller being mounted on said first mounting axle to rotate about said first mounting axle, and
    (c) said rope element contacting said first guide roller about a first portion of the peripheral surface of said first guide roller,
  (6) a second guide roller located adjacent to said first guide roller, with said first guide roller being located between said storage drum and said second guide roller, said second guide roller including
    (a) a peripheral surface and a longitudinal centerline which is oriented to be parallel to said first guide roller longitudinal centerline,
    (b) a second mounting axle attached to said housing body, said second guide roller being mounted on said second mounting axle to rotate about said second mounting axle, and
    (c) said rope element contacting said second guide roller about a first portion of the peripheral surface of said second guide roller,
  (7) said first and second guide rollers and said storage drum being in a stacked configuration with said first guide roller first peripheral surface portion being on an opposite side of said first guide roller from said second guide roller first peripheral surface portion so that said rope element snakes around said first guide roller,
  (8) a cam element mounted on said housing body adjacent to said storage drum, said cam element being mounted on an axle to rotate and having two lobe ends, said lobe ends abutting against the portion of the rope element located on said storage drum when said cam element is in a first position and being spaced from said storage drum to define a gap when said cam element is in a second position as said cam element rotates, said cam element axle being mounted on said housing body, and
  (9) a torsion spring connected at one end thereof to said housing body and connected at another end thereof to said cam element axle and biasing said axle to rotate; and (E) said rope element extending between said cam element and said storage drum to be jammed against the portion of said rope element on said storage drum when said cam element is in said first position and preventing further rope from moving off of said storage drum, and to be released when said cam element is in said second position to permit further rope to move off of said storage drum.

5. The assembly defined in claim 4 further including an MOS switch connected to said Wheatstone Bridge means.

* * * * *